US006480087B1

(12) United States Patent
Oiwa et al.

(10) Patent No.: US 6,480,087 B1
(45) Date of Patent: Nov. 12, 2002

(54) LAMINATED INDUCTOR ARRAY

(75) Inventors: Naotaka Oiwa, Yokaichi; Hiroyuki Takeuchi, Shiga-ken; Motoi Nishii, Omihachiman; Yoshihiro Nishinaga, Hikone, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 46 days.

(21) Appl. No.: 09/664,594

(22) Filed: Sep. 18, 2000

(30) Foreign Application Priority Data

Sep. 17, 1999 (JP) ..... 11-263981

(51) Int. Cl.[7] ..... H01F 5/00
(52) U.S. Cl. ..... 336/200; 336/223; 336/232
(58) Field of Search ..... 336/200, 223, 336/232

(56) References Cited

U.S. PATENT DOCUMENTS 5,578,981 A * 11/1996 Tokuda ..... 336/171
6,191,667 B1 * 2/2001 Takenaka et al. ..... 333/185

FOREIGN PATENT DOCUMENTS

JP 11016738 A * 1/1999
JP 11016760 A * 1/1999

* cited by examiner

*Primary Examiner*—Anh Mai
(74) *Attorney, Agent, or Firm*—Keating & Bennett, LLP

(57) ABSTRACT

In a laminated inductor array, four spiral inductors are aligned from the left end surface to the right end surface of a laminated body. In the direction of alignment of the spiral inductors, the number of the coil conductors on the side portion of the left end surface of the inductor located close to the left end portion of the laminated body and the number of the coil conductors on the side portion of the right end surface of the inductor located close to the right end portion of the laminated body are the same.

19 Claims, 9 Drawing Sheets

LAMINATED INDUCTOR ARRAY

BACKGROUND OF THE INVENTION

1. Field of the Invention

The present invention relates to a laminated inductor array-having a plurality of inductors.

2. Description of the Related Art

A conventional laminated inductor array of the type shown in FIG. 9 is known. The laminated inductor array 1 includes magnetic sheets 2 on the surface of which coil conductors 3*a*–6*e* are provided. The coil conductors 3*a*–3*e* are electrically connected in series through via holes 12 provided in the magnetic sheets 12 to constitute a spiral inductor L1. Similarly, coil conductors 4*a*–4*e*, 5*a*–5*e*, and 6*a*–6*e* are electrically connected in series through via holes 12 provided in the magnetic sheets 12 to constitute spiral inductors L2, L3, and L4, respectively.

The magnetic sheets 2 are stacked on each other in order as shown in FIG. 9, and after magnetic cover sheets (not illustrated) having no conductor provided thereon, have been disposed on the top and bottom surfaces of the stacked magnetic sheets 2, they are integrally sintered to form a laminated body 15 as shown in FIG. 10. On the front and back surfaces of the laminated body 15, external electrodes 21*a*–24*a* and 21*b*–24*b* of the inductors L1–L4 are provided, respectively.

In the laminated inductor array 1 having the above-described construction, to provide a small-sized inductor array, when the inductors L1–L4 are disposed close to each other inside the laminated body 15, the magnetic path of each of the inductors L1–L4 interferes with one another, and the mutual magnetic coupling between the inductors L1–L4 becomes too large to disregard the coupling. As a result, the inductors L1–L4 inside the laminated body 15 often have different values of inductance.

Generally, the spiral inductors L1 and L4 located adjacent the left and right end surfaces of the laminated body 15 have less inductance, because the magnetic paths are narrowed at the end surfaces. In particular, as in the spiral inductor L4, when the number of the coil conductors 6*b*, 6*c*, and 6*d* on the left side in FIG. 11 is three and the number of the coil conductors 6*a*, 6*b*, 6*d*, and 6*e* on the right side in FIG. 11 is four, on the side of the end surface of the laminated body 15 where the number of the coil conductors is greater, the inductance is less than where the number of coil conductors is fewer, as explained in the following and the inductances become different between the inductors L1 and L4. That is, in each of the inductors L1–L4, the greater the number of the coil conductors, the larger the potential inductance is, and when the effective area of the magnetic path of coil conductors of a greater number as in the inductor L4 is reduced, the inductance is further decreased.

SUMMARY OF THE INVENTION

To overcome the above-described problems, preferred embodiments of the present invention provide a laminated inductor array including a plurality of inductors provided in a laminated body and which inductors have minimal variations in the inductance values thereof.

A laminated inductor array according to a preferred embodiment of the present invention includes a laminated body including a plurality of magnetic layers and a plurality of coil conductors provided thereon, a plurality of spiral inductors defined by the coil conductors which are electrically connected to one another and which are aligned in the laminated body, and external electrodes provided on the surfaces of the laminated body and connected to a lead-out end portion of each of the spiral inductors. In the laminated inductor array, in the direction of alignment of the spiral inductors, the number of the coil conductors on an end of the spiral inductor located at one end portion of the laminated body is equal to the number of coil conductors on an end of the spiral inductor located at the other end portion of the laminated body.

Further, a laminated inductor array according to another preferred embodiment of the present invention is constructed such that, in the direction of alignment of spiral inductors, at least a pattern of the coil conductor of the spiral inductor located at one end portion of the laminated body is symmetric about a central line with respect to a pattern of the coil conductor of the spiral inductor located at the other end portion of the laminated body.

Furthermore, a laminated inductor array according another preferred embodiment of the present invention is constructed such that, in the direction of alignment of spiral inductors, one lead-out portion of the respective spiral inductors located at one end portion and the other end portion of the laminated body respectively is led out from the middle of the respective spiral inductors.

Generally, the effective area of the magnetic path of two spiral inductors located at the end portions of a laminated body are reduced on the side of the end surfaces of the laminated body. However, because the number of the coil conductors on the end surface of a spiral conductor located at one end portion of a laminated body is equal to the number of the coil conductors on the end surface of a spiral conductor located at the other end portion of the laminated body, the decreased inductance value of the two spiral inductors located at the end portions of the laminated body is substantially equal and the inductance value of both inductors is therefore substantially equal.

Other features, elements, characteristics and advantages of preferred embodiments of the present invention will become apparent from the following detailed description of preferred embodiments thereof with reference to the attached drawings.

DETAILED DESCRIPTION OF PREFERRED EMBODIMENTS

Hereinafter, preferred embodiments of a laminated inductor array according to the present invention will be described with reference to the accompanying drawings.

Figure 1:
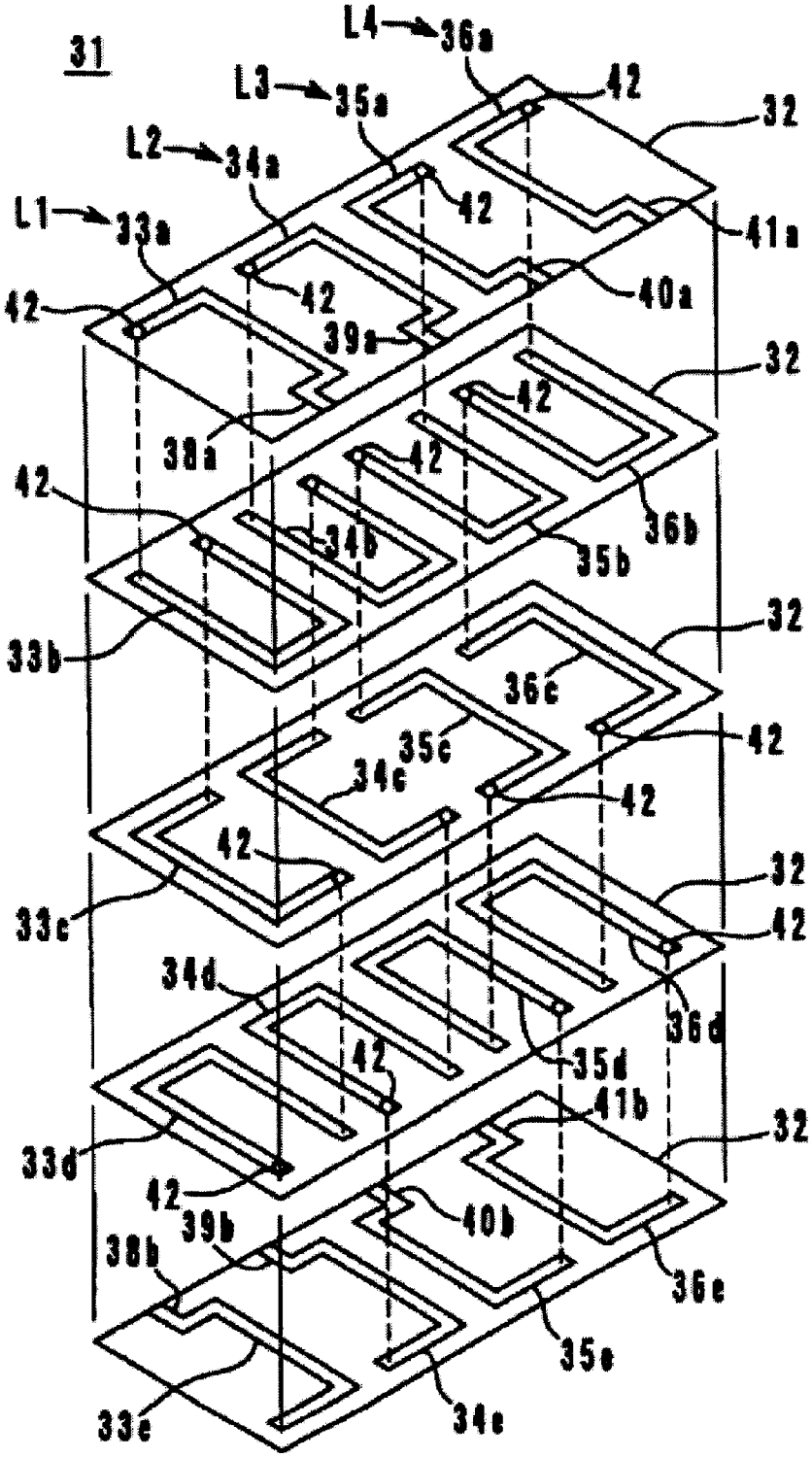
FIG. 1 is an exploded perspective view showing the construction of a first preferred embodiment of a laminated inductor array according to the present invention.

As shown in FIG. 1, a laminated inductor array 31 according to a first preferred embodiment of the present invention preferably includes substantially rectangular magnetic sheets 32 on the surface of which coil conductors 33*a*–36*a*, 33*b*–36*b*, 33*c*–36*c*, 33*d*–36*d*, and 33*e*–36*e* are provided. The coil conductors 33*a*–36*e* are formed on the surface of the magnetic sheets 32 by printing, sputtering, deposition, or other suitable methods. The coil conductors 33*a*–33*e* are preferably made of Ag, Ag—Pd, Cu, Ni, or other suitable material. The magnetic sheets 32 are made of a magnetic material, such as ferrite.

The coil conductors 33*a*–33*e* are electrically connected in series through via holes 42 provided in the magnetic sheets 32 to define a spiral inductor L1 having approximately 3.5 turns. Similarly, the coil conductors 34*a*–34*e*, 35*a*–35*e*, and 36*a*–36*e* are electrically connected in series through via holes 42 provided in the magnetic sheets 32 to define spiral inductors L2, L3, and L4 having approximately 3.5 turns, respectively.

The spiral inductors L1 and L2 are wound counterclockwise, and the spiral inductors L3 and L4 are wound clockwise. That is, the patterns of the coil conductors 33*a*–33*e* and 34*a*–34*e* defining the spiral inductors L1 and L2 and the patterns of the coil conductors 35*a*–35*e*and 36*a*–36*e* defining the inductors L3 and L4 are arranged so as to be symmetric with respect to a central line on the sheets 32.

One end of the inductor L1 (that is, a lead-out conductor 38*a* connected to the coil conductor 33*a*) is exposed on the front left side portion of the sheet 32, and the other end of the inductor L1 (that is, a lead-out conductor 38*b* connected to the coil conductor 33*e*) is exposed on the back left side portion of the sheet 32. One end of the inductor L2 (a lead-out conductor 39*a* connected to the coil conductor 34*a*) is exposed at an intermediate left side portion on the front side portion of the sheet 32, and the other end of the inductor L2 (a lead-out conductor 39*b* connected to the coil conductor 34*e*) is exposed at an intermediate left side portion on the back side portion of the sheet 32. One end of the inductor L3 (a lead-out conductor 40*a* connected to the coil conductor 35*a*) is exposed at an intermediate right side portion on front side portion of the sheet 32, and the other end of the inductor L3 (a lead-out conductor 40*b* connected to the coil conductor 35*e*) is exposed at an intermediate right side portion on the back side portion of the sheet 32. One end of the inductor L4 (a lead-out conductor 41*a* connected to the coil conductor 36*a*) is exposed on the front right side portion of the sheet 32, and the other end of the inductor L4 (a lead-out conductor 41*b* connected to the coil conductor 36*e*) is exposed on the back right side portion of the sheets 32.

Figure 2:
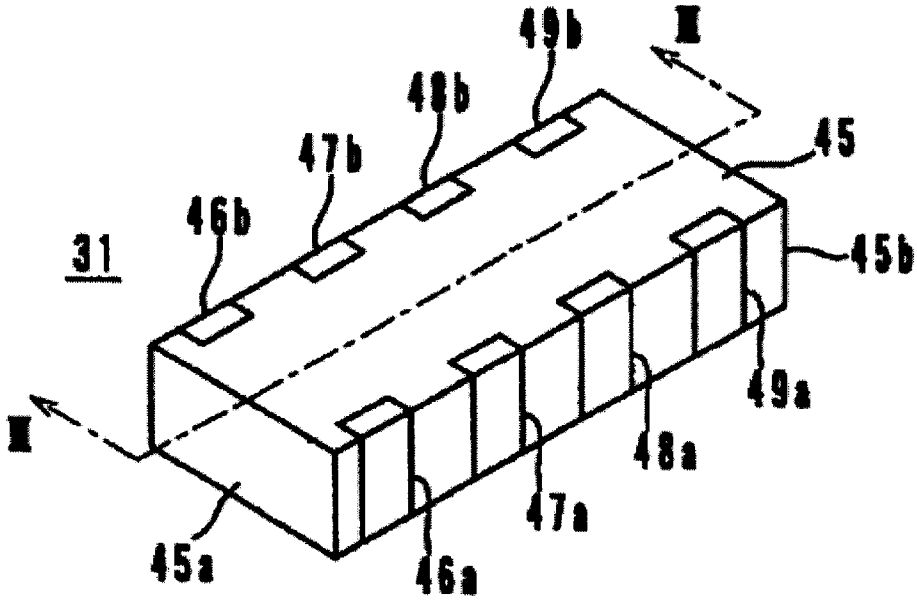
FIG. 2 is a perspective view of the appearance of the laminated inductor array shown in FIG. 1.

The above-mentioned magnetic sheets 32 are stacked one sheet on another in order as shown in FIG. 1, and after magnetic cover sheets having no conductor provided thereon have been disposed on the top and bottom surfaces of the other magnetic sheets 32, the stacked sheets are integrally sintered to form a laminated body 45 as shown in FIG. 2. On the side surfaces on front and back side portions of the laminated body 45, external electrodes 46*a*–49*a* and 46*b*–49*b* of the L1–L4 are provided, respectively. The external electrodes 46*a*–49*a* are electrically connected to the lead-out conductors 38*a*–41*a* on one side portion of the inductors L1–L4 respectively, and the external electrodes 46*b*–49*b* are electrically connected to the lead-out conductors 38*b*–41*b* on the other side portions of the inductors L1–L4. These external electrodes 46*a*–49*a* and 46*b*–49*b* are formed such that after a conductive paste of Ag, Ag—Pd, Cu, Ni, etc. has been coated, the conductive paste is sintered and the sintered paste is wet-plated thereon.

Figure 3:
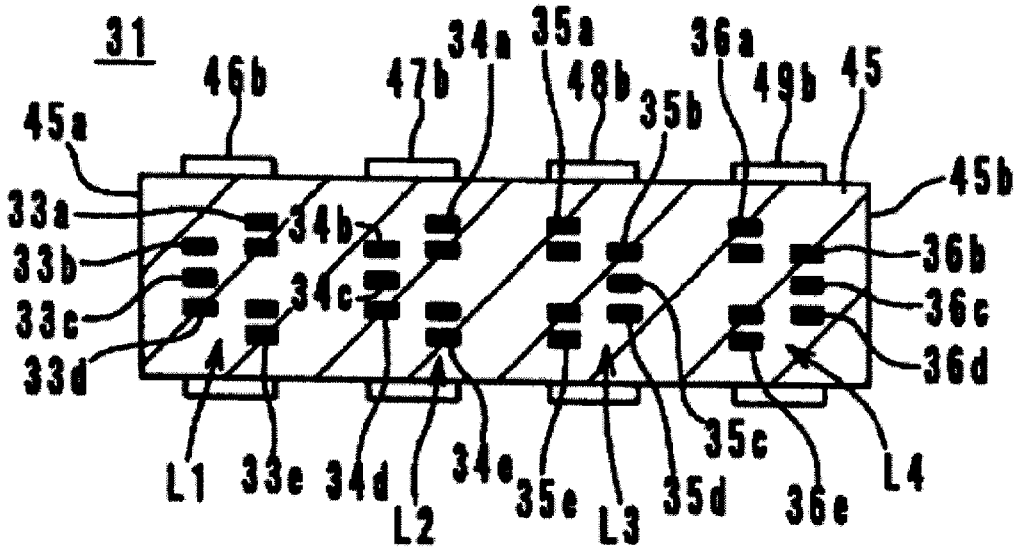
FIG. 3 is a sectional view taken on line III—III of FIG. 2.

In the laminated inductor array 31 having the above construction, the four spiral inductors L1–L4 are arranged in a line from the left end surface 45*a* to the right end surface 45*b* of the laminated body 45 in the laminated body 45, as shown in FIG. 3. In the direction of the arrangement of the spiral inductors L1–L4, the number of the coil conductors on the side portion of the left end surface 45*a*, of the inductor L1 located at the left end portion of the laminated body 45 and the number of the coil conductors on the side of the right end surface 45*b* of the inductor L4 located at the right end portion of the laminated body 45 are the same. In particular, in this particular preferred embodiment of the present invention, there are three coil conductors on the side of the left end surface 45*a* of the inductor L1, and particularly, the coil conductors 33*b*, 33*c*, and 33*d*. There are four coil conductors on the opposite side of the coil conductors 33*b*, 33*c*, and 33*d*, and particularly, the coil conductors 33*a*, 33*b*, 33*d*, and 33*e*. There are three coil conductors on the side of the right end surface 45*b* of the inductor L4, and particularly, the coil conductors 36*b*, 36*c*, and 36*d*. There are four coil conductors on the opposite side of the coil conductors 36*b*, 36*c*, and 36*d*, and particularly, the coil conductors 36*a*, 36*b*, 36*d*, and 36*e*.

The effective area of the magnetic path of the spiral inductor L1 is reduced on the side of the left end surface 45*a* of the laminated body 45, and the effective area of the magnetic path of the spiral inductor L4 is also reduced on the side of the right end surface 45*b* of the laminated body 45. However, because the number of the coil conductors on the side of the left end surface 45*a* of the inductor L1 is equal to the number of the coil conductors on the side of the right end surface 45*b* of the inductor L4, the two inductors L1 and L4 are equally reduced in inductance, and accordingly both have substantially the same inductance values. As a result, a laminated inductor array 31 having minimal variations in the inductance values is obtained.

Figure 4:
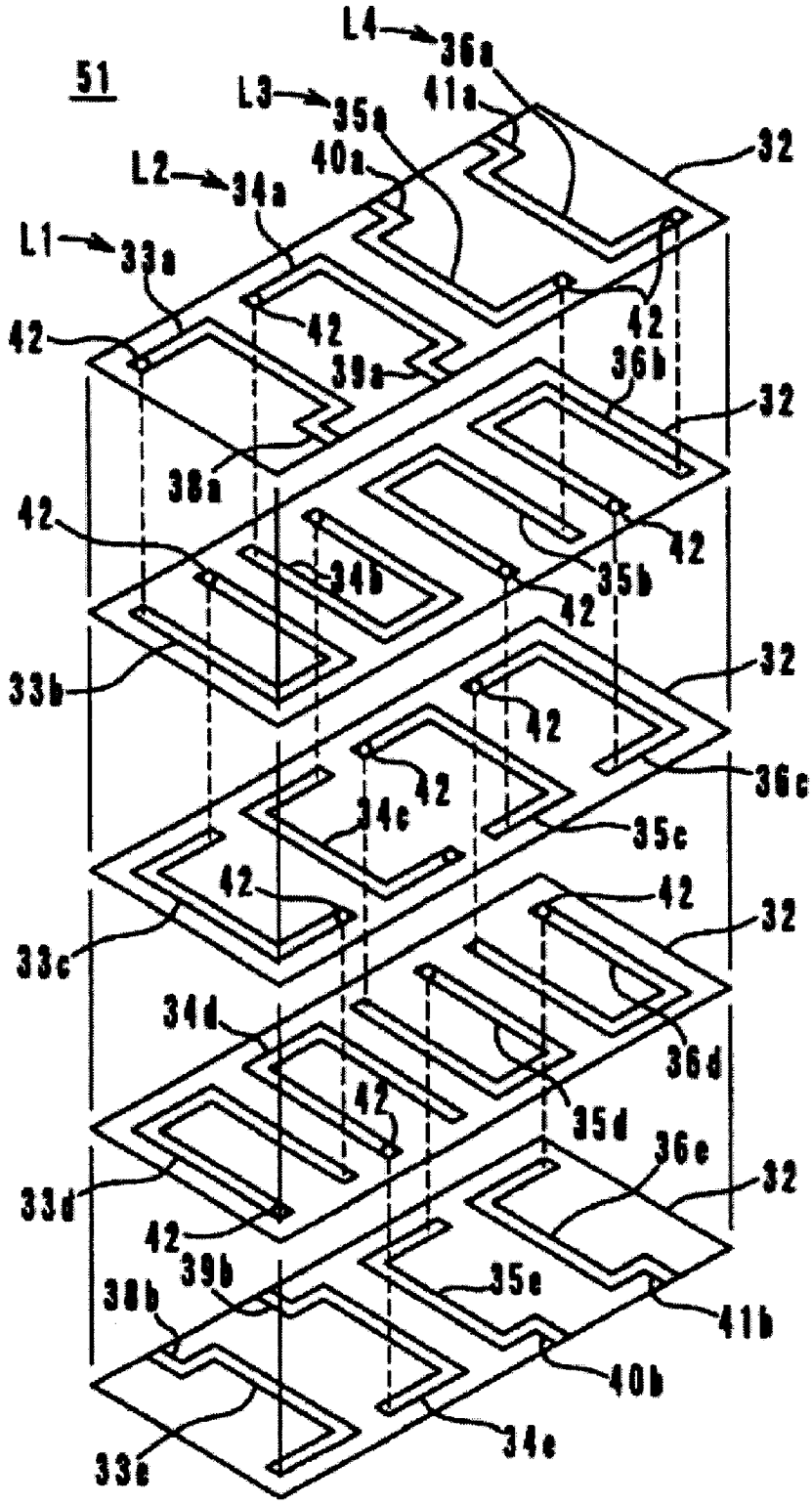
FIG. 4 is an exploded perspective view showing the construction of a second preferred embodiment of a laminated inductor array according to the present invention.

As shown in FIG. 4, a laminated inductor array 51 according to a second preferred embodiment is constructed such that in the laminated inductor array 31 shown in FIGS. 1–3, the pattern of the coil conductors 33*a*–33*e* and 3*a*–34*e* defining the inductors L1 and L2 and the pattern of the coil conductors 35*a*–35*e* and 36*a*–36*e* defining the inductors L3 and L4 are rotationally symmetrical on the magnetic sheets 32.

One end portion of the inductor L3 (a lead-out conductor 40*a*) is exposed to the right of the middle on the back side portion of the sheet 32, and the other end portion (a lead-out conductor 40*b*) is exposed to the right of the middle on the front side portion of the sheet 32. One end portion of the inductor L4 (a lead-out conductor 41*a*) is exposed on the back right side portion of the sheet 32, and the other end portion (a lead-out conductor 41*b*) is exposed on the front right side portion of the sheet 32. Further, the spiral inductors L1–L4 are all wound in a counterclockwise direction.

The laminated inductor array 51 having the unique construction described above produces the same result as the laminated inductor array 31 according to the first preferred embodiment.

Figure 6:
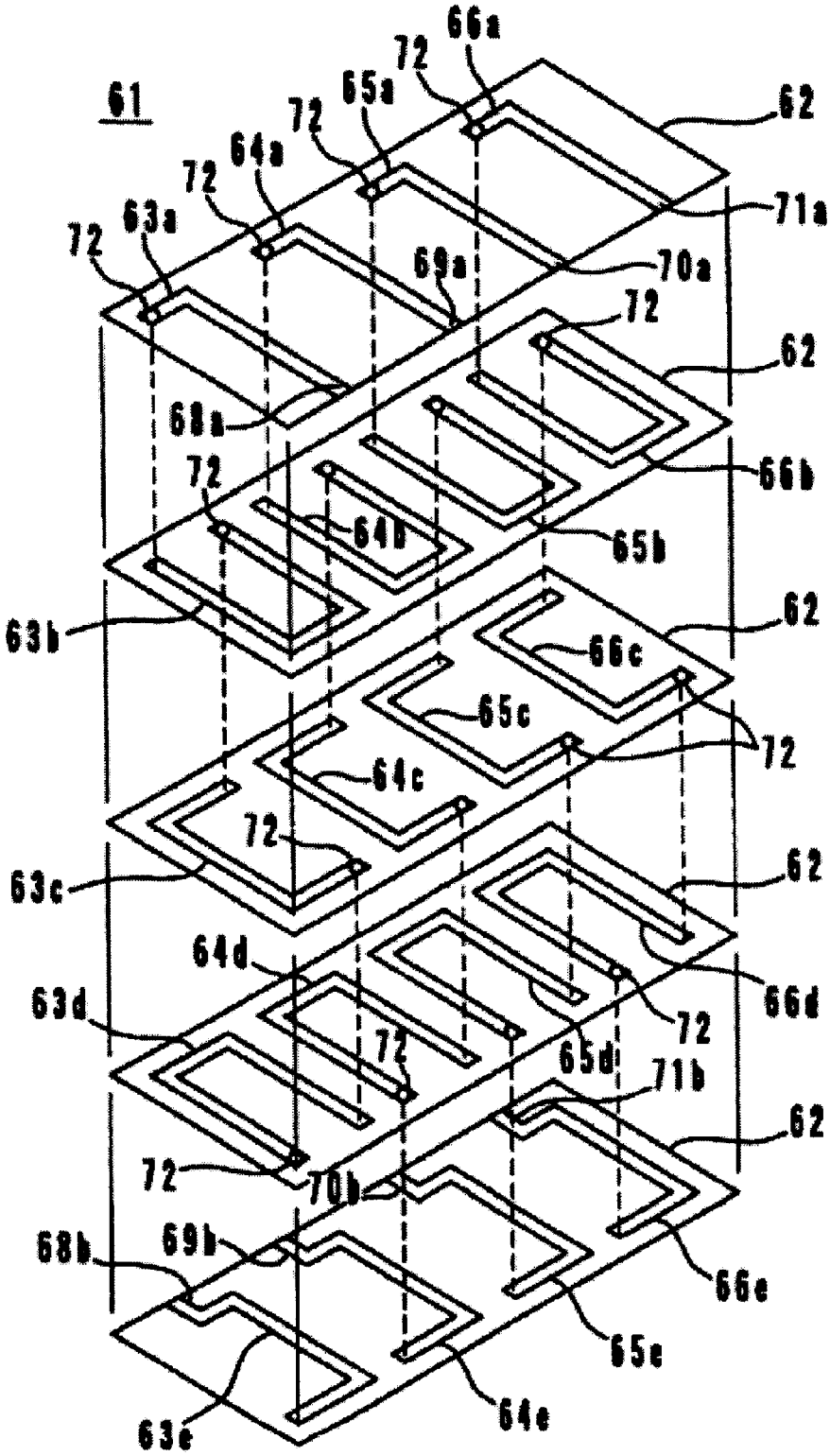
FIG. 6 is an exploded perspective view showing the construction of a third preferred embodiment of a laminated inductor array according to the present invention.

As shown in FIG. 6, a laminated inductor array 61 according to a third preferred embodiment of the present invention preferably includes substantially rectangular magnetic sheets on the surface of which coil conductors 63*a*–66*a*, 63*b*–66*b*, 63*c*–66*c*, 63*d*–66*d*, and 63*e*–66*e* are provided. The coil conductors 63*a*–63*e* are electrically connected in series through via holes 72 provided in the magnetic sheets 62 to define a spiral inductor L1 having approximately 3.5 turns. Similarly, the coil conductors 64*a*–64*e*, 65*a*–65*e*, and 66*a*–66*e* are also electrically connected in series through via holes 72 provided in the magnetic sheets 62 to define spiral inductors L2, L3, and L4 having approximately 3.5 turns.

The spiral inductors L1–L4 are wound in a counterclockwise direction. That is, the coil conductors 63*a*–63*e*, 64*a*–64*e*, 65*a*–65*e*, and 66*a*–66*e* defining the inductors L1, L2, L3, and L4 are arranged in the same direction on the sheets 62.

One end portion of the inductor L1 (that is, a lead-out conductor 68*a* connected to the coil conductor 63*a*) is exposed on the front left side portion of the sheet 62, and the other end portion (a lead-out conductor 68*b* connected to the coil conductor 63*e*) is exposed on the back left side portion of the sheet 62. One end portion of the inductor L2 (a lead-out conductor 69*a* connected to the coil conductor 64*a*) is exposed to the left of the middle of the front side portion of the sheet 62, and the other end portion (a lead-out conductor 69*b* connected to the coil conductor 64*e*) is exposed to the left of the middle of the back side portion of the sheet 62. One end portion of the inductor L3 (a lead-out conductor 70*b* connected to the coil conductor 65*a*) is exposed to the right of the middle of the front side portion of the sheet 62, and the other end portion (a lead-out conductor 70*b* connected to the coil conductor 65*e*) is exposed to the right of the middle of the back side portion of the sheet 62. One end portion of the inductor L4 (a lead-out conductor 71*a* connected to the coil conductor 66*a*) is exposed on the front right side portion of the sheet 62, and the other end portion (a lead-out conductor 71*b* connected to the coil conductor 66*e*) is exposed on the back right side portion of the sheet 62.

The above magnetic sheets 62 are laminated one sheet on another in order as shown in FIG. 6, and after magnetic cover sheets (not illustrated), having no conductor provided thereon, have been disposed on the top and bottom surfaces of the other magnetic sheets 62. They are integrally sintered to form a laminated body 75. On the side surfaces of the laminated body 75, the external electrodes 46*a*–49*a* and 46*b*–49*b* of the inductors L1–L4 are provided, respectively, as shown in FIG. 2. The external electrodes 46*a*–49*a* are electrically connected to the lead-out conductors 68*a*–71*a* of end portions of the inductors L1–L4, respectively, and the external electrodes 46*b*–49*b* are electrically connected to the lead-out conductors 68*b*–71*b* of the other end portions of the inductors L1–L4, respectively.

Figure 7:
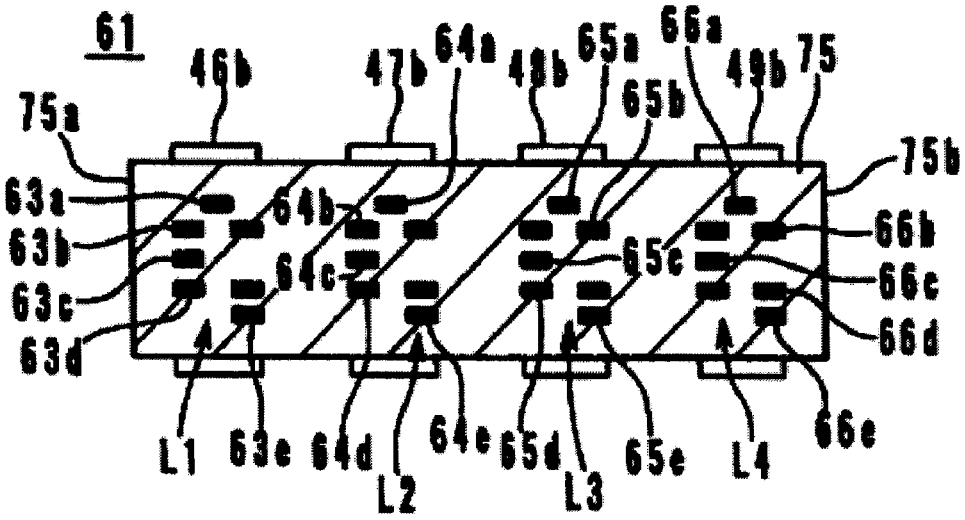
FIG. 7 is a sectional view of the laminated inductor array shown in FIG. 6.

In the laminated inductor array 61 having the above construction, the four spiral inductors L1–L4 are arranged in a line from the left end surface 75*a* to the right end surface 75*b* of the laminated body 75, in the laminated body 75 as shown in FIG. 7. The lead-out conductors 68*a*–71*a* of the inductors L1–L4 are led out from the middle of each of the inductors L1–L4. With this configuration, the number of the coil conductors on the side of the left end surface 75*a* of the inductor L1 located close to the left end portion of the laminated body 75, and the number of the coil conductors on the side of the right end surface 75*b* of the inductor L4 located close to the right end portion of the laminated body 75 are equal. More particularly, in this preferred embodiment, there are three coil conductors on the side of the left end surface 75*a* of the inductor L1 is three, and particular, coil conductors 63*b*, 63*c*, and 63*d*. There are three coil conductors on the opposite side of the coil conductors 63*b*, 63*c*, and 63*d*, and particularly, coil conductors 63*b*, 63*d*, and 63*e*. On the other hand, there are three coil conductors on the side of the right end surface 75*b* of the inductor L4, and particularly, coil conductors 66*b*, 66*d*, and 66*e*. There are three coil conductors on the opposite side of the coil conductors 66*b*, 66*d*, and 66*e*, and particularly, coil conductors 66*b*, 66*c*, and 66*d*.

Here, the effective area of the magnetic path of the spiral inductor L1 is reduced on the side portions of the left end surface 75*a* of the laminated body 75, and the effective area of the magnetic path of the spiral inductor L4 is reduced on the side portion of the right end surface 75*b* of the laminated body 75. However, because the number of the coil conductors on the side portions of the left end surface 75*a* of the inductor L1 is equal to the number of the coil conductors on the side of the right end surface 75*b* of the inductor L4, the two inductors L1 and L4 have equally reduced inductances, and accordingly both have substantially the same inductance. As a result, a laminated inductor array 61 having minimal variations in the inductance values is obtained.

Further, the coil conductors 33*a*–36*a* through 33*e*–33*e*–36*e* are disposed at uniform intervals on the same sheets 62, such that the lead-out conductors 68*a*–71*a* of the inductors L1–L4 are led out from the middle of each of the inductors L1–L4, and accordingly the via holes are equally spaced. Therefore, although the distance between via holes 72 is limited in the process of forming the via holes by using molding dies, or other suitable methods, because the via holes are equally spaced, smaller inductor arrays can be produced in comparison with the cases where the via holes are not equally spaced. Furthermore, because the coil conductors of the same shape 33*a*–36*a* through 33*e*–33*e*–36*e* are arranged at uniform intervals, when the coil conductors 33*a*–36*a*through 33*e*–36*e* are printed on the same sheets 62, variations in printing (running, shear in printing, etc.) among the coil conductors 33*a*–36*a* is greatly reduced.

Figure 9:
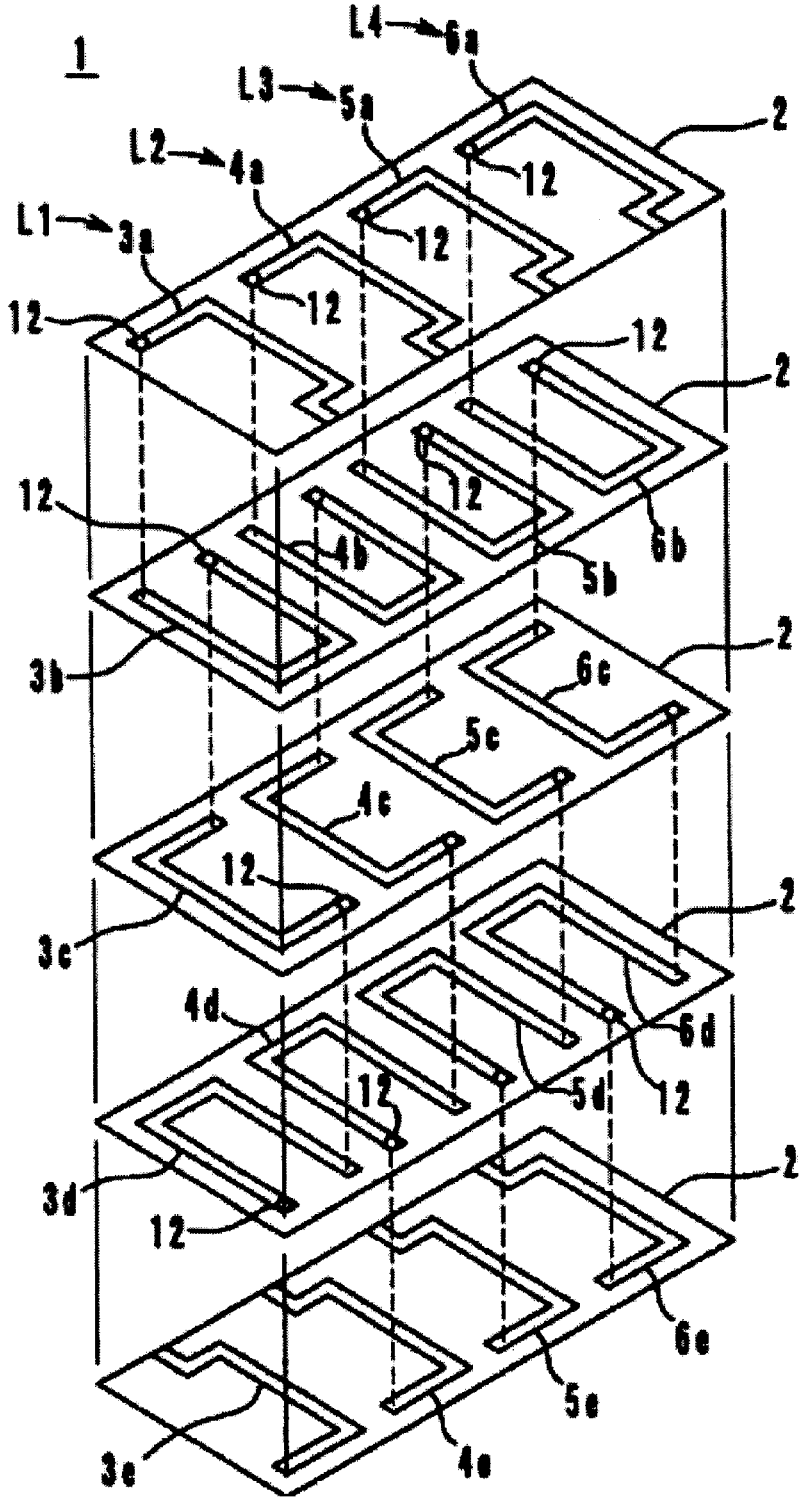
Fig. 9 PRIOR ART
FIG. 9 is an exploded perspective view showing the construction of a conventional laminated inductor array.
Figure 10:
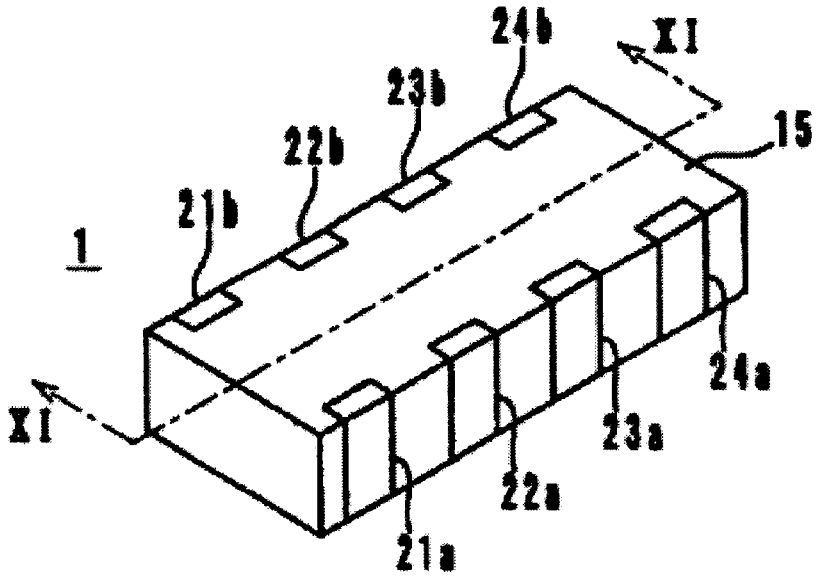
Fig. 10 PRIOR ART
FIG. 10 is a perspective view of the laminated inductor array shown in FIG. 9.
Figure 11:
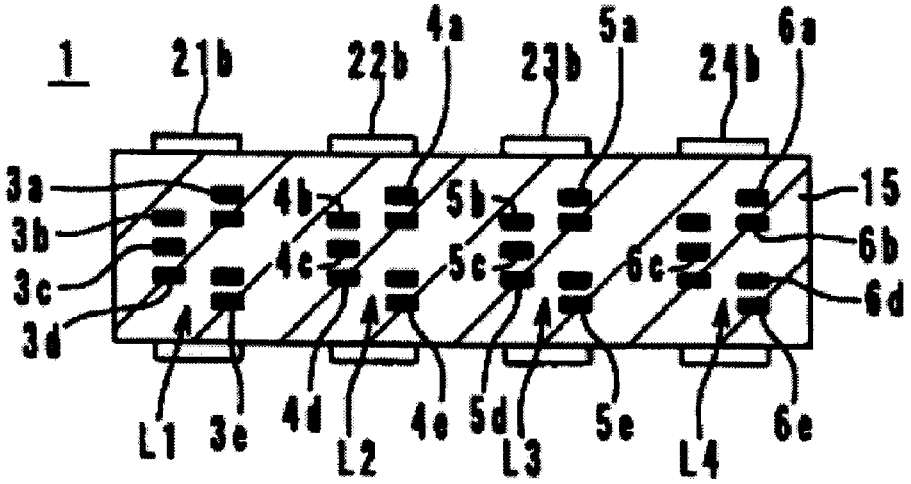
Fig. 11 PRIOR ART
FIG. 11 is a sectional view taken along line XI—XI of FIG. 10.

When the coil conductors 63*a*–66*e* according to the third preferred embodiment are compared with the coil conductors 3*a*–6*e* of the conventional inductor array 1 shown in FIGS. 9–11, only the coil conductors 63*a*–66*a* connected to the lead-out conductors 68*a*–71*a* differ from the conventional inductor array. Therefore, by changing the coil conductors 3*a*–6*a* the coil conductors excluding the coil conductors 3*a*–6*a* can be utilized without modification.

Further, a laminated inductor array according to the present invention is not limited to the above-described preferred embodiments, and various changes are contemplated within the scope of the invention.

Figure 8:
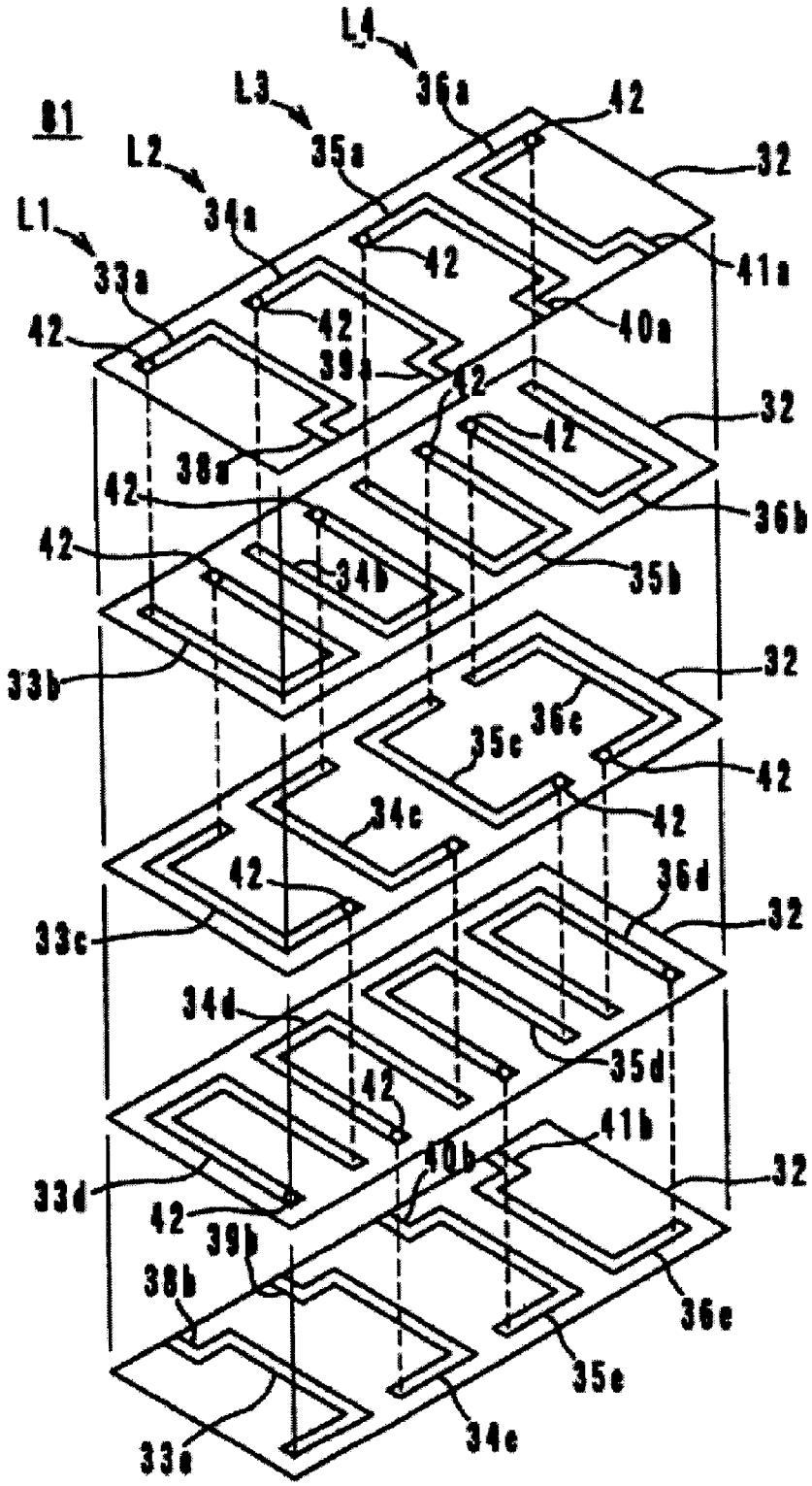
FIG. 8 is an exploded perspective view showing the construction of another preferred embodiment.

In the present invention, because the number of the coil conductors on the side portion of one end surface of a laminated body of a spiral inductor located close to the end surface and the number of the coil conductors on the side portion of the other end surface of the laminated body of a spiral inductor located close to the other end surface are the same, inductors L1 and L2 and inductors L3 and L4 are not necessarily required to be disposed so as to be symmetric with respect to a central line as in the case of the laminated inductor array 31 according to the first preferred embodiment, and only the inductors L1 and L4 located close to both end surfaces of the laminated body may be arranged so as to be symmetric with respect to a central line as in the laminated inductor array 81 shown in FIG. 8.

Further, the number of the inductors contained in a laminated body may be two, three, five or more as opposed to the four inductors of the preferred embodiments.

In the above-described preferred embodiments, after the magnetic sheets on which patterns are provided have been stacked one sheet on another in order, they are integrally sintered, but the process is not limited to this process. Magnetic sheets which have previously been sintered may be used. Further, inductor arrays may be formed by the following manufacturing method. After magnetic layers are formed by a method of printing, or other suitable method using a paste of magnetic material, a paste material for forming conductive patterns is printed on the surface of the magnetic layers to provided patterns of any shape. Next, the paste of magnetic material is applied over the pattern to form magnetic layers containing the pattern therebetween. By repeating these processes in same manner, an inductor array of a laminated construction is obtained.

Figure 5:
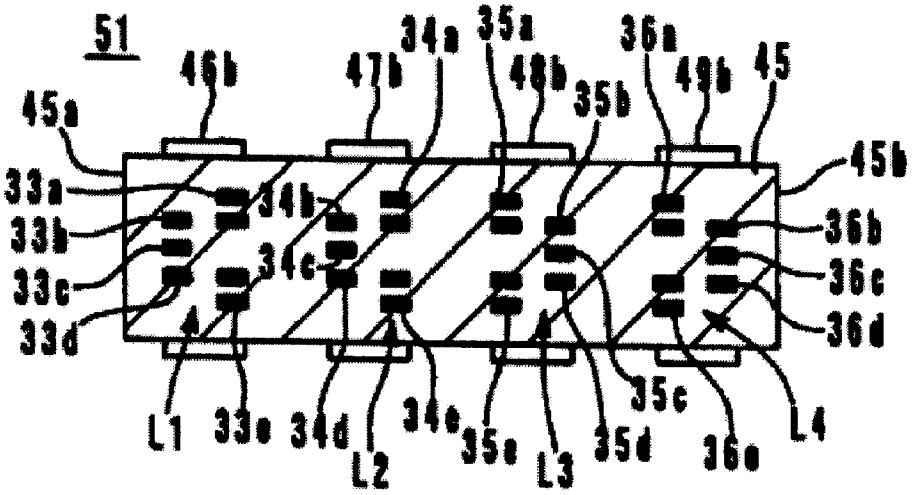
FIG. 5 is a sectional view of the laminated inductor array shown in FIG. 4.

Under the conditions described below, variations of the inductance values of the laminated inductor array 31 as shown in FIGS. 1–3 (sample A), the laminated inductor array 51 shown in FIGS. 4 and 5 (sample B), the laminated inductor array 61 shown in FIGS. 6 and 7 (sample C), and the laminated inductor array 81 shown in FIG. 8 (sample D) are shown in Table 1. In Table 1, variations of the inductance values of the conventional laminated inductor array 1 shown in FIGS. 9–11 (conventional one) are also given for comparison. Further, regarding the conventional inductor and sample A in Table 1 the inductance values of trial products where the number of winding of the spiral inductors are varied was measured and the measurement of those was corrected so as to be compared with the cases where the number of winding is approximately 3.5 turns. As for samples B, C, and D, the inductance values were estimated based on the actual measurement of the trial products of the conventional inductor and sample A. Conditions of the samples Dimensions of chip: 3.2 mm×1.6 mm×0.8 mm Width of the pattern of coil conductor: 120 $\mu$m at printing Thickness of coil conductor: 15 $\mu$m at printing Thickness of magnetic sheet: 50 $\mu$m at printing

TABLE 1

| | Value of inductance at 1 MHz($\mu$H) | | | | Variations of the value of |
|---|---|---|---|---|---|
| | L1 | L2 | L3 | L4 | inductance (%) |
| Sample A | 1.739 | 1.775 | 1.779 | 1.745 | 2.3 |
| Sample B | 1.744 | 1.778 | 1.783 | 1.742 | 2.3 |
| Sample C | 1.474 | 1.513 | 1.522 | 1.487 | 3.2 |
| Sample D | 1.731 | 1.796 | 1.758 | 1.734 | 3.7 |
| Conventional one | 1.743 | 1.791 | 1.761 | 1.570 | 12.9 |

In Table 1, variations of the inductance values were calculated by using the following formula.

$$\{(\mathrm{Lmax}-\mathrm{Lmin})/Lx\}\times 100$$

Lmax maximum value of inductance

Lmin minimum value of inductance

Lx : average value of inductance

According to Table 1, samples A–D have greatly improved variations of the inductance values as compared to the conventional inductor.

As clearly understood from the above description, according to preferred embodiments of the present invention, because the number of the coil conductors on the side portion of one end surface of a laminated body of a coil conductor located close to the end surface and the number of the coil conductors on the side portion of the other end surface of the laminated body of a coil conductor located close to the other end surface are the same, the two spiral inductors close to both end portions of the laminated body are substantially equally reduced in inductance, and accordingly both inductors have substantially equal inductance values. As a result, without sacrificing the coupling coefficient between inductors and the reliability, variations of the inductance values of a plurality of inductors which are provided inside a laminated body of limited dimensions are greatly reduced. Further, because the length of the coil conductors and the width of the patterns are not changed between inductors, variations of the DC resistance of inductors do not occur.

Further, when lead-out end portions of spiral inductors are led out from the middle of each of the spiral inductors, by changing only the pattern of the lead-out ends, the other patterns can be utilized as originally designed. Furthermore, because the via holes and coil conductors are uniformly aligned on the same magnetic layers, inductor arrays having reduced sizes are produced.

It should be understood that the foregoing description of preferred embodiments is only illustrative of the present invention. Various alternatives and modifications can be devised by those skilled in the art without departing from the invention. Accordingly, the present invention is intended to embrace all such alternatives, modifications and variations that fall within the scope of the appended claims.

What is claimed is:

1. A laminated inductor array comprising:

a laminated body including a plurality of magnetic layers having a plurality of coil conductors thereon and laminated together;

a plurality of spiral inductors defined by the coil conductors being electrically connected and aligned in the laminated body; and external electrodes provided on surfaces of the laminated body and electrically connected to lead-out end portions of each of the plurality of spiral inductors, wherein in the direction of alignment of the plurality of spiral inductors, the number of the coil conductors on one end portion of the spiral inductor located at one end portion of the laminated body is equal to the number of the coil conductors on the end portion of the spiral inductor located at the other end portion of the laminated body.

2. A laminated inductor array as claimed in claim 1, wherein in the direction of alignment of the spiral inductors, at least one pattern of the coil conductor of the spiral inductor located at one end portion of the laminated body is symmetric with respect to at least one pattern of the coil conductor of the spiral inductor located at the other end portion of the laminated body.

3. A laminated inductor array as claimed in claim 1, wherein in the direction of alignment of the spiral inductors, one lead-out portion of the respective spiral inductors located at one end portion and the other end portion of the laminated body respectively is led out from the middle of the respective spiral inductors.

4. A laminated inductor array as claimed in claim 1, wherein said plurality of coil conductors includes approximately 3.5 turns.

5. A laminated inductor array as claimed in claim 1, wherein each of said plurality of spiral inductors are wound in the same direction.

6. A laminated inductor array as claimed in claim 5, wherein each of said plurality of spiral inductors are wound in the counterclockwise direction.

7. A laminated inductor array as claimed in claim 1, wherein said plurality of spiral inductors include four spiral inductors.

8. A laminated inductor array as claimed in claim 1, wherein the number of the coil conductors on the one end portion of the spiral inductor located at one end portion of the laminated body and the number of the coil conductors on the end portion of the spiral inductor located at the other end portion of the laminated body is three.

9. A laminated inductor array as claimed in claim 1, wherein each of said plurality of magnetic layers includes substantially rectangular shaped magnetic sheets.

10. A laminated inductor array comprising:

a laminated body including a plurality of magnetic layers having a plurality of coil conductors thereon and laminated together;

a plurality of spiral inductors defined by the coil conductors being electrically connected and aligned in the laminated body; wherein in the direction of alignment of the plurality of spiral inductors, the number of the coil conductors on one end portion of the spiral inductor located at one end portion of the laminated body is equal to the number of the coil conductors on the end portion of the spiral inductor located at the other end portion of the laminated body.

11. A laminated inductor array as claimed in claim 10, further including external electrodes provided on surfaces of the laminated body and electrically connected to lead-out end portions of each of the plurality of spiral inductors.

12. A laminated inductor array as claimed in claim 10, wherein in the direction of alignment of the spiral inductors, at least one pattern of the coil conductor of the spiral inductor located at one end portion of the laminated body is symmetric with respect to at least one pattern of the coil conductor of the spiral inductor located at the other end portion of the laminated body.

13. A laminated inductor array as claimed in claim 10, wherein in the direction of alignment of the spiral inductors, one lead-out portion of the respective spiral inductors located at one end portion and the other end portion of the laminated body respectively is led out from the middle of the respective spiral inductors.

14. A laminated inductor array as claimed in claim 10, wherein said plurality of coil conductors includes approximately 3.5 turns.

15. A laminated inductor array as claimed in claim 10, wherein each of said plurality of spiral inductors are wound in the same direction.

16. A laminated inductor array as claimed in claim 15, wherein each of said plurality of spiral inductors are wound in the counterclockwise direction.

17. A laminated inductor array as claimed in claim 10, wherein said plurality of spiral inductors include four spiral inductors.

18. A laminated inductor array as claimed in claim 10, wherein the number of the coil conductors on the one end portion of the spiral inductor located at one end portion of the laminated body and the number of the coil conductors on the end portion of the spiral inductor located at the other end portion of the laminated body is three coil conductors.

19. A laminated inductor array as claimed in claim 10, wherein each of said plurality of magnetic layers includes substantially rectangular shaped magnetic sheets.

* * * * *